US010221365B2

(12) United States Patent
Bourane et al.

(10) Patent No.: US 10,221,365 B2
(45) **Date of Patent: *Mar. 5, 2019**

(54) INTEGRATED SOLVENT DEASPHALTING AND STEAM PYROLYSIS SYSTEM FOR DIRECT PROCESSING OF A CRUDE OIL

(71) Applicant: Saudi Arabian Oil Company, Dhahran (SA)

(72) Inventors: Abdennour Bourane, Ras Tanura (SA); Raheel Shafi, Manama (BH); Essam Sayed, Dhahran (SA); Ibrahim A. Abba, Dhahran (SA); Abdul Rahman Zafer Akhras, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/928,672

(22) Filed: Mar. 22, 2018

(65) Prior Publication Data

US 2018/0208862 A1 Jul. 26, 2018

Related U.S. Application Data

(60) Division of application No. 15/069,144, filed on Mar. 14, 2016, which is a continuation of application No.
(Continued)

(51) Int. Cl.
*C10G 55/04* (2006.01)
*C10G 9/36* (2006.01)
(Continued)

(52) U.S. Cl.
CPC ..... *C10G 55/04* (2013.01); *C10G 9/36* (2013.01); *C10G 19/00* (2013.01); *C10G 21/003* (2013.01);
(Continued)

(58) Field of Classification Search
CPC ..... C10G 21/003; C10G 2300/201; C10G 2300/308; C10G 2300/4081;
(Continued)

(56) References Cited

U.S. PATENT DOCUMENTS 2,729,589 A 1/1956 Waghorne
3,842,138 A 10/1974 Chahvekilan et al.
(Continued)

FOREIGN PATENT DOCUMENTS

EP 0673989 A2 9/1995
EP 1555308 A1 7/2005
(Continued)

OTHER PUBLICATIONS

Harper, S, Chevron Port Arthur ethylene expansion meets objectives, Oil and Gas Journal, 1999, vol. 97, Issue 19.*
(Continued)

*Primary Examiner* — Renee Robinson
*Assistant Examiner* — Derek N Mueller
(74) *Attorney, Agent, or Firm* — Abelman, Frayne & Schwab

(57) ABSTRACT

A system is provided integrating a steam pyrolysis zone integrated with a solvent deasphalting zone to permit direct processing of crude oil feedstocks to produce petrochemicals including olefins and aromatics.

17 Claims, 3 Drawing Sheets

Related U.S. Application Data

13/865,041, filed on Apr. 17, 2013, now Pat. No. 9,284,497, which is a continuation-in-part of application No. PCT/US2013/023333, filed on Jan. 27, 2013.

(60) Provisional application No. 61/788,996, filed on Mar. 15, 2013, provisional application No. 61/591,783, filed on Jan. 27, 2012.

(51) Int. Cl.
*C10G 19/00* (2006.01)
*C10G 21/00* (2006.01)

(52) U.S. Cl.
CPC ..... *C10G 2400/20* (2013.01); *C10G 2400/30* (2013.01)

(58) Field of Classification Search
CPC ..... C10G 2400/20; C10G 2400/30; C10G 45/00; C10G 67/0463; C10G 67/049; C10G 69/06; C10G 9/36
See application file for complete search history.

(56) References Cited

U.S. PATENT DOCUMENTS

| | | | |
|---|---|---|---|
| 3,944,481 | A | 3/1976 | Wing et al. |
| 4,002,556 | A | 1/1977 | Satchell |
| 4,065,379 | A | 12/1977 | Soonawala et al. |
| 4,115,467 | A | 9/1978 | Fowler |
| 4,180,453 | A | 12/1979 | Franck et al. |
| 4,502,950 | A | 3/1985 | Ikematsu et al. |
| 4,798,665 | A | 1/1989 | Humbach et al. |
| 5,192,421 | A | 3/1993 | Audeh et al. |
| 5,258,117 | A | 11/1993 | Kolstad et al. |
| 5,906,728 | A | 5/1999 | Iaccino et al. |
| 6,190,533 | B1 | 2/2001 | Bradow et al. |
| 6,210,561 | B1 | 4/2001 | Bradow et al. |
| 6,303,842 | B1 | 10/2001 | Bridges et al. |
| 6,632,351 | B1 | 10/2003 | Ngan et al. |
| 7,220,887 | B2 | 5/2007 | Stell et al. |
| 7,311,746 | B2 | 12/2007 | Stell et al. |
| 7,408,093 | B2 | 8/2008 | Stell et al. |
| 7,951,745 | B2 | 5/2011 | Zhou et al. |
| 7,972,498 | B2 | 7/2011 | Buchanan et al. |
| 8,070,938 | B2 | 12/2011 | Stein et al. |
| 8,071,833 | B2 | 12/2011 | Grootjans et al. |
| 2004/0004028 | A1 | 1/2004 | Stell et al. |
| 2004/0054247 | A1 | 3/2004 | Powers et al. |
| 2005/0150817 | A1 | 7/2005 | Tallman et al. |
| 2005/0261530 | A1 | 11/2005 | Stell et al. |
| 2007/0090018 | A1* | 4/2007 | Keusenkothen ..... C10G 9/007 208/106 |
| 2007/0090020 | A1 | 4/2007 | Buchanan et al. |
| 2007/0095032 | A1 | 5/2007 | Nilsen et al. |
| 2007/0232846 | A1 | 10/2007 | Baumgartner et al. |
| 2010/0087692 | A1 | 4/2010 | Yoshimura et al. |
| 2011/0042269 | A1 | 2/2011 | Kuechler et al. |
| 2011/0174682 | A1 | 7/2011 | Iaccino |
| 2011/0247500 | A1 | 10/2011 | Akhras et al. |
| 2013/0046122 | A1 | 2/2013 | Vermeiren et al. |

FOREIGN PATENT DOCUMENTS

| | | | |
|---|---|---|---|
| JP | S58-098387 | A | 6/1983 |
| JP | S60-163996 | A | 8/1985 |
| WO | 2007047942 | A2 | 4/2007 |
| WO | 2009088413 | A1 | 7/2009 |

OTHER PUBLICATIONS

Parkash, S., Refining Processes Handbook, 2003, pp. 197-209.*
PCT/US2013/023333, International Search Report and Written Opinion dated Jun. 19, 2013, 14 pages.
JP 2014-554901, Office Action dated Nov. 1, 2016, 14 pages.

* cited by examiner

INTEGRATED SOLVENT DEASPHALTING AND STEAM PYROLYSIS SYSTEM FOR DIRECT PROCESSING OF A CRUDE OIL

RELATED APPLICATIONS

This application is a divisional application of U.S. patent application Ser. No. 15/069,144 filed on Mar. 14, 2016, which is a continuation application of U.S. patent application Ser. No. 13/865,041 filed on Apr. 17, 2013, now U.S. Pat. No. 9,284,497 issued on Mar. 15, 2016, which claims the benefit of priority under 35 USC § 119(e) to U.S. Provisional Patent Application No. 61/788,996 filed Mar. 15, 2013, and is a Continuation-in-Part under 35 USC § 365(c) of PCT Patent Application No. PCT/US13/23333 filed Jan. 27, 2013, which claims the benefit of priority under 35 USC § 119(e) to U.S. Provisional Patent Application No. 61/591,783 filed Jan. 27, 2012, all of which are incorporated herein by reference in their entireties.

BACKGROUND OF THE INVENTION

Field of the Invention

The present invention relates to an integrated solvent deasphalting and steam pyrolysis process for direct processing of a crude oil to produce petrochemicals such as olefins and aromatics.

Description of Related Art

The lower olefins (i.e., ethylene, propylene, butylene and butadiene) and aromatics (i.e., benzene, toluene and xylene) are basic intermediates which are widely used in the petrochemical and chemical industries. Thermal cracking, or steam pyrolysis, is a major type of process for forming these materials, typically in the presence of steam, and in the absence of oxygen. Feedstocks for steam pyrolysis can include petroleum gases and distillates such as naphtha, kerosene and gas oil. The availability of these feedstocks is usually limited and requires costly and energy-intensive process steps in a crude oil refinery.

Studies have been conducted using heavy hydrocarbons as a feedstock for steam pyrolysis reactors. A major drawback in conventional heavy hydrocarbon pyrolysis operations is coke formation. For example, a steam cracking process for heavy liquid hydrocarbons is disclosed in U.S. Pat. No. 4,217,204 in which a mist of molten salt is introduced into a steam cracking reaction zone in an effort to minimize coke formation. In one example using Arabian light crude oil having a Conradson carbon residue of 3.1% by weight, the cracking apparatus was able to continue operating for 624 hours in the presence of molten salt. In a comparative example without the addition of molten salt, the steam cracking reactor became clogged and inoperable after just 5 hours because of the formation of coke in the reactor.

In addition, the yields and distributions of olefins and aromatics using heavy hydrocarbons as a feedstock for a steam pyrolysis reactor are different than those using light hydrocarbon feedstocks. Heavy hydrocarbons have a higher content of aromatics than light hydrocarbons, as indicated by a higher Bureau of Mines Correlation Index (BMCI). BMCI is a measurement of aromaticity of a feedstock and is calculated as follows:

$$BMCI=87552/VAPB+473.5*(sp.\ gr.)-456.8 \quad (1)$$

where:

VAPB=Volume Average Boiling Point in degrees Rankine and sp. gr.=specific gravity of the feedstock.

As the BMCI decreases, ethylene yields are expected to increase. Therefore, highly paraffinic or low aromatic feeds are usually preferred for steam pyrolysis to obtain higher yields of desired olefins and to avoid higher undesirable products and coke formation in the reactor coil section.

The absolute coke formation rates in a steam cracker have been reported by Cai et al., "Coke Formation in Steam Crackers for Ethylene Production," *Chem. Eng. & Proc.*, vol. 41, (2002), 199-214. In general, the absolute coke formation rates are in the ascending order of olefins>aromatics>paraffins, wherein olefins represent heavy olefins.

To be able to respond to the growing demand of these petrochemicals, other type of feeds which can be made available in larger quantities, such as raw crude oil, are attractive to producers. Using crude oil feeds will minimize or eliminate the likelihood of the refinery being a bottleneck in the production of these petrochemicals.

While the steam pyrolysis process is well developed and suitable for its intended purposes, the choice of feedstocks has been very limited.

SUMMARY OF THE INVENTION

The system and process herein provides a steam pyrolysis zone integrated with a solvent deasphalting zone to permit direct processing of crude oil feedstocks to produce petrochemicals including olefins and aromatics.

The integrated solvent deasphalting and steam pyrolysis process for the direct processing of a crude oil to produce olefinic and aromatic petrochemicals comprises charging the crude oil to a solvent deasphalting zone with an effective amount of solvent to produce a deasphalted and demetalized oil stream and a bottom asphalt phase; thermally cracking the deasphalted and demetalized oil stream in the presence of steam to produce a mixed product stream; separating the mixed product stream; recovering olefins and aromatics from the separated mixed product stream; and recovering pyrolysis fuel oil from the separated mixed product stream.

As used herein, the term "crude oil" is to be understood to include whole crude oil from conventional sources, including crude oil that has undergone some pre-treatment. The term crude oil will also be understood to include that which has been subjected to water-oil separation; and/or gas-oil separation; and/or desalting; and/or stabilization.

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawings are illustrative and are provided to further the understanding of the various aspects and embodiments of the process of the invention.

BRIEF DESCRIPTION OF THE DRAWINGS

The invention will be described in further detail below and with reference to the attached drawings where.

DETAILED DESCRIPTION OF THE INVENTION

Figure 1:
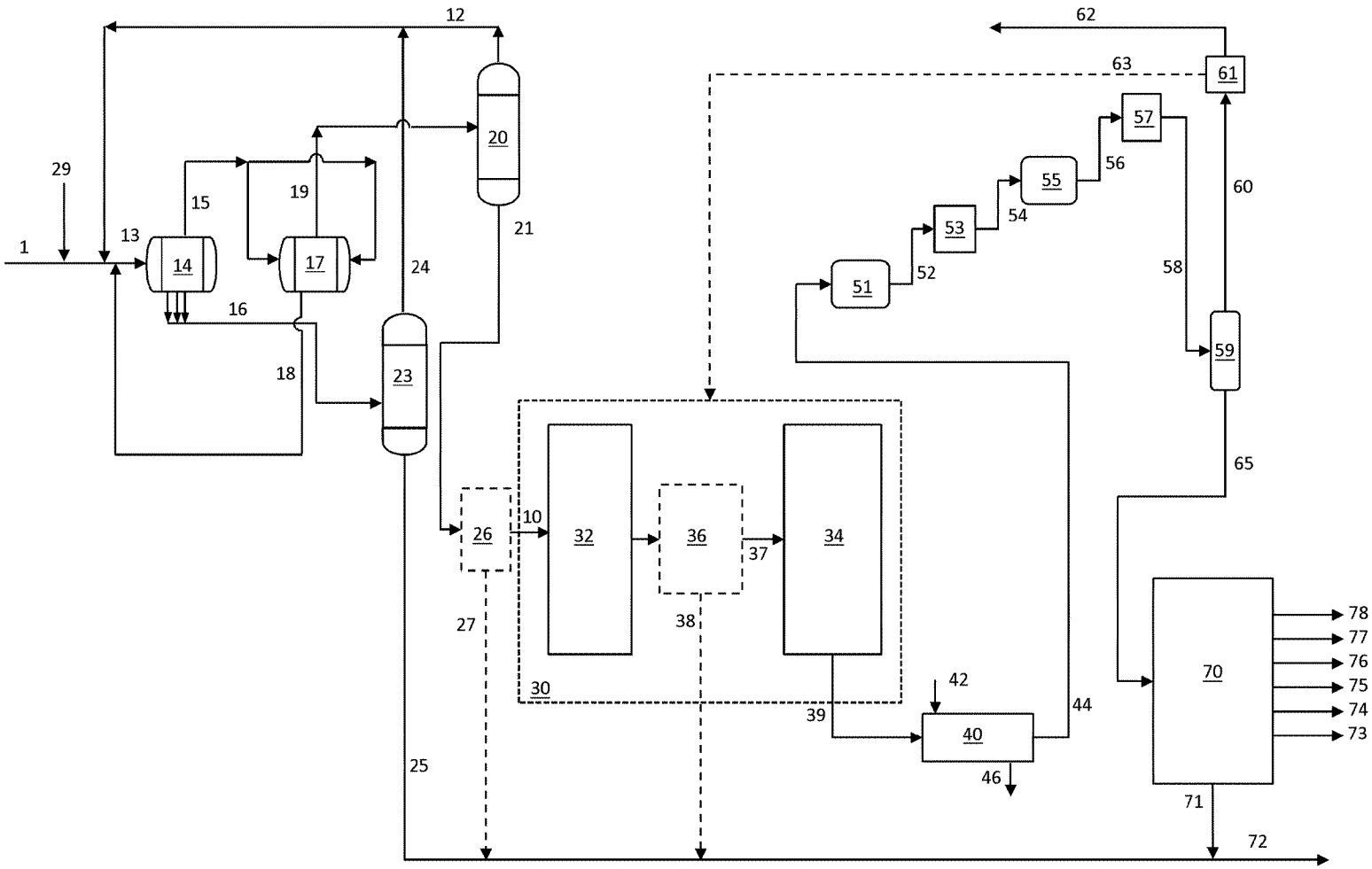
FIG. 1 is a process flow diagram of an embodiment of an integrated process described herein.

A flow diagram including an integrated solvent deasphalting and steam pyrolysis process and system is shown in FIG. 1. The integrated system includes a solvent deasphalting zone, a steam pyrolysis zone and a product separation zone.

Solvent deasphalting zone generally includes a primary settler 14, a secondary settler 17, a solvent deasphalted/demetalized oil (DA/DMO) separation zone 20, and a separator zone 23.

Primary settler 14 includes an inlet for receiving a combined stream 13 including a feed stream 1 and a solvent, which can be fresh solvent 29, recycle solvent 12, recycle solvent 24, or a combination comprising one or more of these solvent sources. Primary settler 14 also includes an outlet for discharging a primary DA/DMO phase 15 and several pipe outlets for discharging a primary asphalt phase 16. Secondary settler 17 includes two tee-type distributors located at both ends for receiving the primary DA/DMO phase 15, an outlet for discharging a secondary DA/DMO phase 19, and an outlet for discharging a secondary asphalt phase 18. DA/DMO separation zone 20 includes an inlet for receiving secondary DA/DMO phase 19, an outlet for discharging a solvent stream 12 and an outlet for discharging a solvent-free DA/DMO stream 21, all or a portion of which is used as the steam pyrolysis zone feedstock. Separator vessel 23 includes an inlet for receiving primary asphalt phase 16, an outlet for discharging a solvent stream 24, and an outlet for discharging a bottom asphalt phase 25.

Steam pyrolysis zone 30 generally comprises a convection section 32 and a pyrolysis section 34 that can operate based on steam pyrolysis unit operations known in the art, i.e., charging the thermal cracking feed to the convection section in the presence of steam. In addition, in certain optional embodiments as described herein (as indicated with dashed lines in FIG. 1), a vapor-liquid separation section 36 is included between sections 32 and 34. Vapor-liquid separation section 36, through which the heated steam cracking feed from the convection section 32 passes and is fractioned, can be a flash separation device, a separation device based on physical or mechanical separation of vapors and liquids or a combination including at least one of these types of devices. In additional embodiments, a vapor-liquid separation zone 26 is included upstream of sections 32, either in combination with a vapor-liquid separation zone 36 or in the absence of a vapor-liquid separation zone 36. Stream 21 is fractioned in separation zone 26, which can be a flash separation device, a separation device based on physical or mechanical separation of vapors and liquids or a combination including at least one of these types of devices.

Useful vapor-liquid separation devices are illustrated by, and with reference to FIGS. 2A-2C and 3A-3C. Similar arrangements of a vapor-liquid separation devices are described in U.S. Patent Publication Number 2011/0247500 which is herein incorporated by reference in its entirety. In this device vapor and liquid flow through in a cyclonic geometry whereby the device operates isothermally and at very low residence time. In general vapor is swirled in a circular pattern to create forces where heavier droplets and liquid are captured and channeled through to a liquid outlet as liquid residue which is added to a pyrolysis fuel oil blend, and vapor is channeled through a vapor outlet. In embodiments in which a vapor-liquid separation device 36 is provided, residue 38 is discharged and the vapor is the charge 37 to the pyrolysis section 34. In embodiments in which a vapor-liquid separation device 26 is provided, residue 27 is discharged and the vapor is the charge 10 to the convection section 32. The vaporization temperature and fluid velocity are varied to adjust the approximate temperature cutoff point, for instance in certain embodiments compatible with the residue fuel oil blend, e.g., about 540° C.

A quenching zone 40 includes an inlet in fluid communication with the outlet of steam pyrolysis zone 30 for receiving mixed product stream 39, an inlet for admitting a quenching solution 42, an outlet for discharging the quenched mixed product stream 44 and an outlet for discharging quenching solution 46.

Product stream 44 is generally fractioned into end-products and residue in separation zone 70, which can be one or multiple separation units such as plural fractionation towers including de-ethanizer, de-propanizer and de-butanizer towers, for example as is known to one of ordinary skill in the art. For example, suitable apparatus are described in "Ethylene," Ullmann's Encyclopedia of Industrial Chemistry, Volume 12, Pages 531-581, in particular FIG. 24, FIG. 25 and FIG. 26, which is incorporated herein by reference.

In general product separation zone 70 includes an inlet in fluid communication with the product stream 44, and plural product outlets 73-78, including an outlet 78 for discharging methane, an outlet 77 for discharging ethylene, an outlet 76 for discharging propylene, an outlet 75 for discharging butadiene, an outlet 74 for discharging mixed butylenes, and an outlet 73 for discharging pyrolysis gasoline. Additionally an outlet is provided for discharging pyrolysis fuel oil 71. The bottom asphalt phase 25 from separator vessel 23 and optionally the rejected portion 38 from vapor-liquid separation section 36 are combined with pyrolysis fuel oil 71 and the mixed stream can be withdrawn as a pyrolysis fuel oil blend 72, e.g., a low sulfur fuel oil blend to be further processed in an off-site refinery. Note that while six product outlets are shown, fewer or more can be provided depending, for instance, on the arrangement of separation units employed and the yield and distribution requirements.

In an embodiment of a process employing the arrangement shown in FIG. 1, a crude oil feedstock 1 is admixed with solvent from one or more of sources 29, 12 and 24. The resulting mixture 13 is then transferred to the primary settler 14. By mixing and settling, two phases are formed in the primary settler 14: a primary DA/DMO phase 15 and a primary asphalt phase 16. The temperature of the primary settler 14 is sufficiently low to recover all DA/DMO from the feedstock. For instance, for a system using n-butane a suitable temperature range is about 60° C. to 150° C. and a suitable pressure range is such that it is higher than the vapor pressure of n-butane at the operating temperature e.g. about 15 to 25 bars to maintain the solvent in liquid phase. In a system using n-pentane a suitable temperature range is about 60° C. to about 180° C. and again a suitable pressure range is such that it is higher than the vapor pressure of n-pentane at the operating temperature e.g. about 10 to 25 bars to maintain the solvent in liquid phase. The temperature in the second settler is usually higher than the one in the first settler.

The primary DA/DMO phase 15 including a majority of solvent and DA/DMO with a minor amount of asphalt is discharged via the outlet located at the top of the primary settler 14 and collector pipes (not shown). The primary asphalt phase 16, which contains 20-50% by volume of solvent, is discharged via several pipe outlets located at the bottom of the primary settler 14.

The primary DA/DMO phase 15 enters into the two tee-type distributors at both ends of the secondary settler 17 which serves as the final stage for the extraction. A secondary asphalt phase 18 containing a small amount of solvent and DA/DMO is discharged from the secondary settler 17 and recycled back to the primary settler 14 to recover DA/DMO. A secondary DA/DMO phase 19 is obtained and passed to the DA/DMO separation zone 20 to obtain a solvent stream 12 and a solvent-free DA/DMO stream 21. Greater than 90 wt % of the solvent charged to the settlers enters the DA/DMO separation zone 20, which is dimensioned to permit a rapid and efficient flash separation of solvent from the DA/DMO. The primary asphalt phase 16 is conveyed to the separator vessel 23 for flash separation of a solvent stream 24 and a bottom asphalt phase 25. Solvent streams 12 and 24 can be used as solvent for the primary settler 14, therefore minimizing the fresh solvent 29 requirement.

The solvents used in solvent deasphalting zone include pure liquid hydrocarbons such as propane, butanes and pentanes, as well as their mixtures. The selection of solvents depends on the requirement of DAO, as well as the quality and quantity of the final products. The operating conditions for the solvent deasphalting zone include a temperature at or below critical point of the solvent; a solvent-to-oil ratio in the range of from 2:1 to 50:1 (vol.:vol.); and a pressure in a range effective to maintain the solvent/feed mixture in the settlers is in the liquid state.

The essentially solvent-free DA/DMO stream 21 is optionally steam stripped (not shown) to remove any remaining solvent, and is in certain embodiments the pyrolysis feedstream 10 which is passed to the convection section 32 in the presence of an effective amount of steam, e.g., admitted via a steam inlet (not shown). In additional embodiments as described herein a separation zone 26 is incorporated upstream of the convection section 22 whereby the feed 10 is the light portion of said pyrolysis feed. In the convection section 32 the mixture is heated to a predetermined temperature, e.g., using one or more waste heat streams or other suitable heating arrangement. The heated mixture of the light fraction and steam is optionally passed to the vapor-liquid separation section 36 in which a portion 38 is rejected as a fuel oil component suitable for blending with pyrolysis fuel oil 71. The remaining hydrocarbon portion is conveyed to the pyrolysis section 34 to produce a thermally cracked mixed product stream 39.

In certain embodiments stream 21 is the feed 10 to the steam pyrolysis zone 30. In further embodiments, stream 21 is sent to separation zone 26 wherein the discharged vapor portion is the feed 10 to the steam pyrolysis zone 30. The vapor portion can have, for instance, an initial boiling point corresponding to that of the stream 21 and a final boiling point in the range of about 370° C. to about 600° C. Separation zone 26 can include a suitable vapor-liquid separation unit operation such as a flash vessel, a separation device based on physical or mechanical separation of vapors and liquids or a combination including at least one of these types of devices. Certain embodiments of vapor-liquid separation devices, as stand-alone devices or installed at the inlet of a flash vessel, are described herein with respect to FIGS. 2A-2C and 3A-3C, respectively.

The steam pyrolysis zone 30 operates under parameters effective to crack DA/DMO stream 21 or a light portion 10 thereof derived from the optional separation zone 26, into the desired products, including ethylene, propylene, butadiene, mixed butenes and pyrolysis gasoline. In certain embodiments, steam cracking is carried out using the following conditions: a temperature in the range of from 400° C. to 900° C. in the convection section and in the pyrolysis section; a steam-to-hydrocarbon ratio in the convection section in the range of from 0.3:1 to 2:1 (wt.:wt.); and a residence time in the convection section and in the pyrolysis section in the range of from 0.05 seconds to 2 seconds.

Figure 2B:
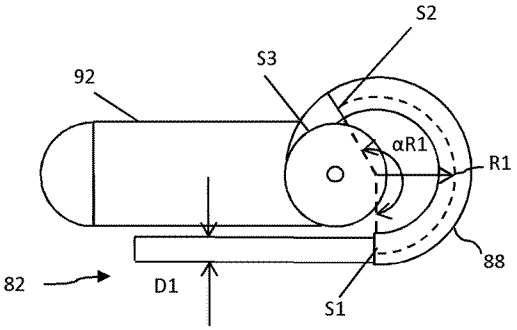
FIGS. 2A-2C are schematic illustrations in perspective, top and side views of a vapor-liquid separation device used in certain embodiments of the integrated process described herein.
Figure 2C:
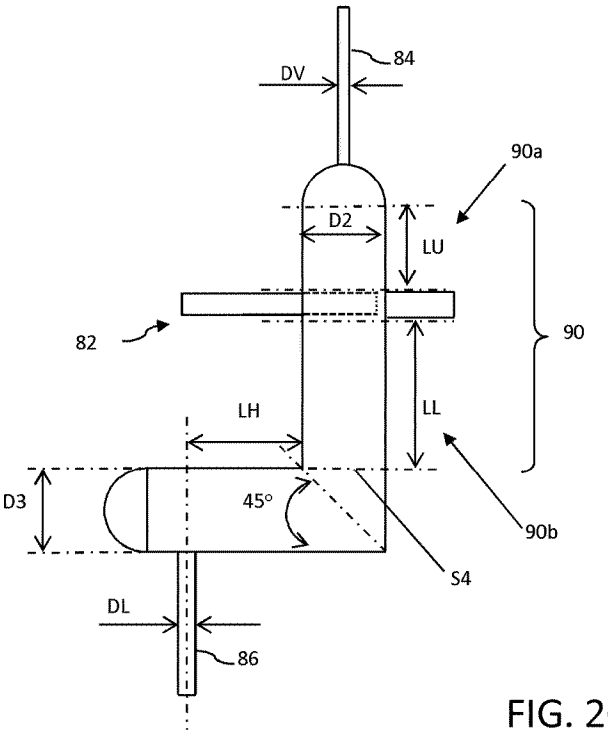
Figure 2A:
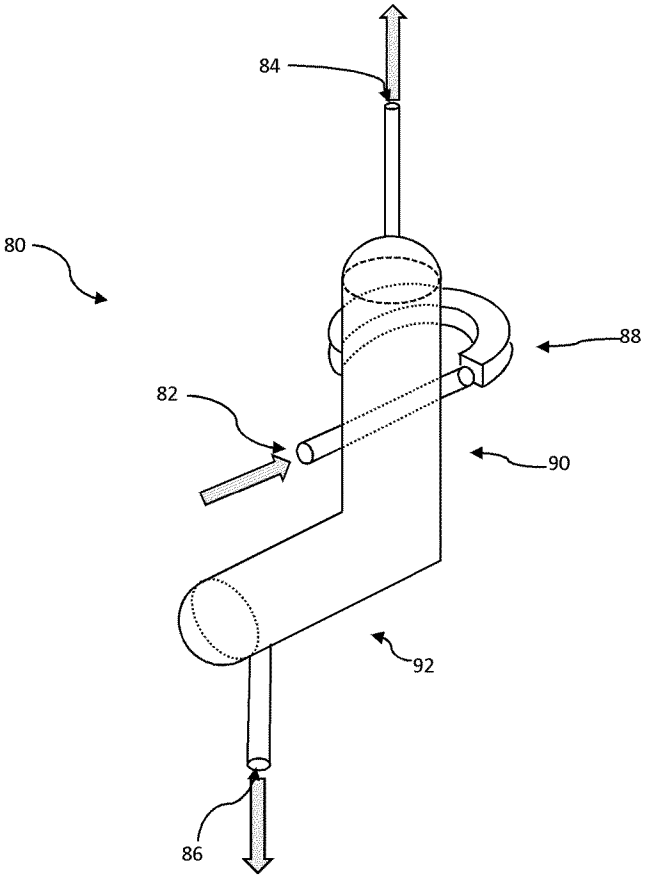

In certain embodiments, the vapor-liquid separation section 36 includes one or a plurality of vapor liquid separation devices 80 as shown in FIGS. 2A-2C. The vapor liquid separation device 80 is economical to operate and maintenance free since it does not require power or chemical supplies. In general, device 80 comprises three ports including an inlet port for receiving a vapor-liquid mixture, a vapor outlet port and a liquid outlet port for discharging and the collection of the separated vapor and liquid, respectively. Device 80 operates based on a combination of phenomena including conversion of the linear velocity of the incoming mixture into a rotational velocity by the global flow pre-rotational section, a controlled centrifugal effect to pre-separate the vapor from liquid (residue), and a cyclonic effect to promote separation of vapor from the liquid (residue). To attain these effects, device 80 includes a pre-rotational section 88, a controlled cyclonic vertical section 90 and a liquid collector/settling section 92.

As shown in FIG. 2B, the pre-rotational section 88 includes a controlled pre-rotational element between cross-section (S1) and cross-section (S2), and a connection element to the controlled cyclonic vertical section 90 and located between cross-section (S2) and cross-section (S3). The vapor liquid mixture coming from inlet 82 having a diameter (D1) enters the apparatus tangentially at the cross-section (S1). The area of the entry section (S1) for the incoming flow is at least 10% of the area of the inlet 82 according to the following equation:

$$\frac{\pi * ([D1])^2}{4} \tag{2}$$

The pre-rotational element 88 defines a curvilinear flow path, and is characterized by constant, decreasing or increasing cross-section from the inlet cross-section S1 to the outlet cross-section S2. The ratio between outlet cross-section from controlled pre-rotational element (S2) and the inlet cross-section (S1) is in certain embodiments in the range of $0.7 \leq S2/S1 \leq 1.4$.

The rotational velocity of the mixture is dependent on the radius of curvature (R1) of the center-line of the pre-rotational element 38 where the center-line is defined as a curvilinear line joining all the center points of successive cross-sectional surfaces of the pre-rotational element 88. In certain embodiments the radius of curvature (R1) is in the range of $2 \leq R1/D1 \leq 6$ with opening angle in the range of $150° \leq \alpha R1 \leq 250°$.

The cross-sectional shape at the inlet section S1, although depicted as generally square, can be a rectangle, a rounded rectangle, a circle, an oval, or other rectilinear, curvilinear or a combination of the aforementioned shapes. In certain embodiments, the shape of the cross-section along the curvilinear path of the pre-rotational element 38 through which the fluid passes progressively changes, for instance, from a generally square shape to a rectangular shape. The progressively changing cross-section of element 88 into a rectangular shape advantageously maximizes the opening area, thus allowing the gas to separate from the liquid mixture at an early stage and to attain a uniform velocity profile and minimize shear stresses in the fluid flow.

The fluid flow from the controlled pre-rotational element 88 from cross-section (S2) passes section (S3) through the connection element to the controlled cyclonic vertical section 40. The connection element includes an opening region that is open and connected to, or integral with, an inlet in the controlled cyclonic vertical section 90. The fluid flow enters the controlled cyclonic vertical section 90 at a high rotational velocity to generate the cyclonic effect. The ratio between connection element outlet cross-section (S3) and inlet cross-section (S2) in certain embodiments is in the range of $2 \leq S3/S1 \leq 5$.

The mixture at a high rotational velocity enters the cyclonic vertical section 90. Kinetic energy is decreased and the vapor separates from the liquid under the cyclonic effect. Cyclones form in the upper level 90*a* and the lower level 90*b* of the cyclonic vertical section 90. In the upper level 90*a*, the mixture is characterized by a high concentration of vapor, while in the lower level 90*b* the mixture is characterized by a high concentration of liquid.

In certain embodiments, the internal diameter D2 of the cyclonic vertical section 90 is within the range of $2 \leq D2/D1 \leq 5$ and can be constant along its height, the length (LU) of the upper portion 90*a* is in the range of $1.2 \leq LU/D2 \leq 3$, and the length (LL) of the lower portion 90*b* is in the range of $2 \leq LL/D2 \leq 5$.

The end of the cyclonic vertical section 90 proximate vapor outlet 34 is connected to a partially open release riser and connected to the pyrolysis section of the steam pyrolysis unit. The diameter (DV) of the partially open release is in certain embodiments in the range of $0.05 \leq DV/D2 \leq 0.4$.

Accordingly, in certain embodiments, and depending on the properties of the incoming mixture, a large volume fraction of the vapor therein exits device 80 from the outlet 84 through the partially open release pipe with a diameter DV. The liquid phase (e.g., residue) with a low or non-existent vapor concentration exits through a bottom portion of the cyclonic vertical section 90 having a cross-sectional area S4, and is collected in the liquid collector and settling pipe 92.

The connection area between the cyclonic vertical section 90 and the liquid collector and settling pipe 92 has an angle in certain embodiments of 90°. In certain embodiments the internal diameter of the liquid collector and settling pipe 92 is in the range of $2 \leq D3/D1 \leq 4$ and is constant across the pipe length, and the length (LH) of the liquid collector and settling pipe 92 is in the range of $1.2 \leq LH/D3 \leq 5$. The liquid with low vapor volume fraction is removed from the apparatus through pipe 86 having a diameter of DL, which in certain embodiments is in the range of $0.05 \leq DL/D3 \leq 0.4$ and located at the bottom or proximate the bottom of the settling pipe.

Figures 3A, 3B, 3C:
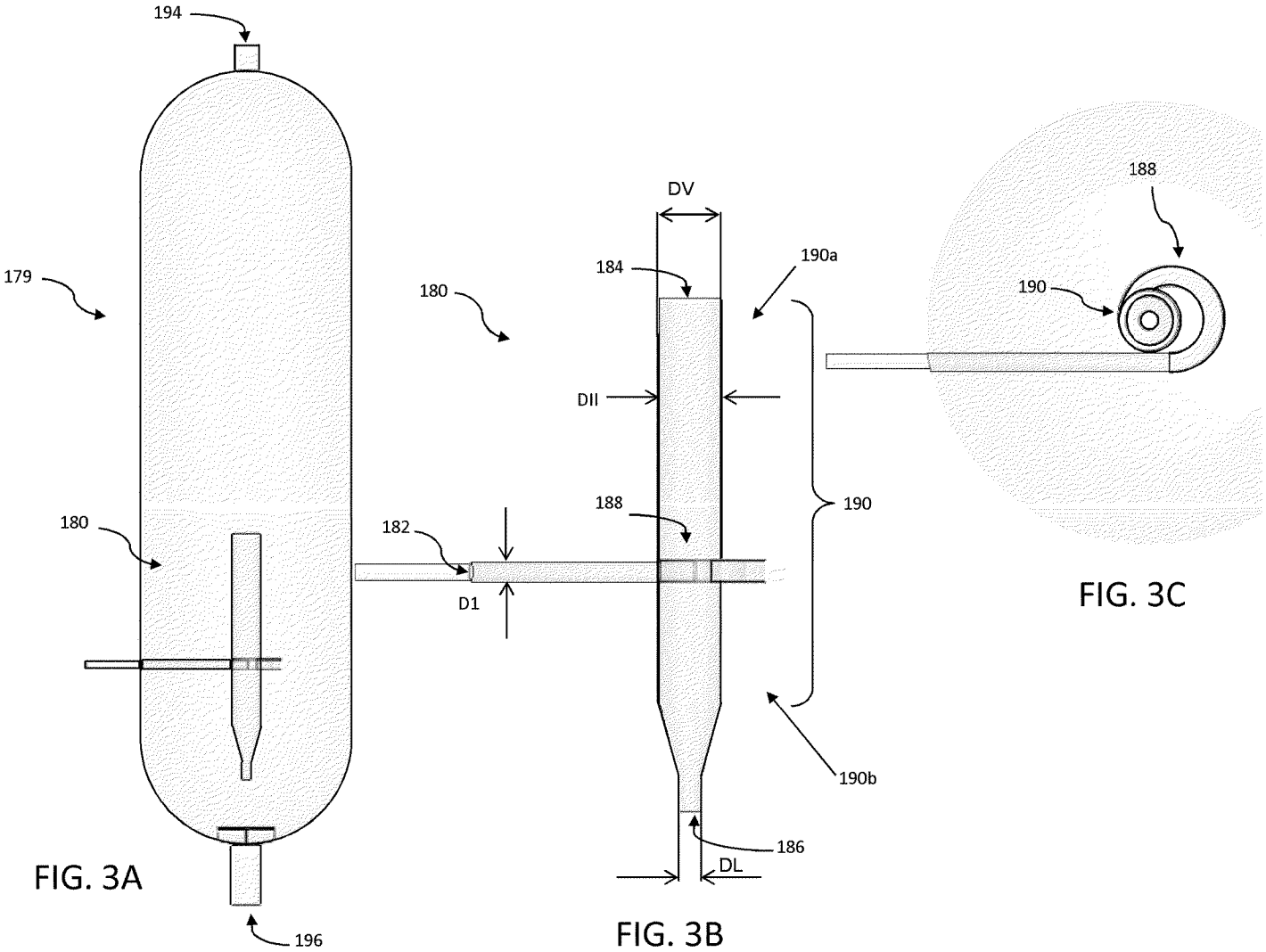
FIGS. 3A-3C are schematic illustrations in section, enlarged section and top section views of a vapor-liquid separation device in a flash vessel used in certain embodiments of the integrated process described herein.

In certain embodiments, a vapor-liquid separation device is provided similar in operation and structure to device 80 without the liquid collector and settling pipe return portion. For instance, a vapor-liquid separation device 180 is used as inlet portion of a flash vessel 179, as shown in FIGS. 3A-3C. In these embodiments the bottom of the vessel 179 serves as a collection and settling zone for the recovered liquid portion from device 180.

In general a vapor phase is discharged through the top 194 of the flash vessel 179 and the liquid phase is recovered from the bottom 196 of the flash vessel 179. The vapor-liquid separation device 180 is economical to operate and maintenance free since it does not require power or chemical supplies. Device 180 comprises three ports including an inlet port 182 for receiving a vapor-liquid mixture, a vapor outlet port 184 for discharging separated vapor and a liquid outlet port 186 for discharging separated liquid. Device 180 operates based on a combination of phenomena including conversion of the linear velocity of the incoming mixture into a rotational velocity by the global flow pre-rotational section, a controlled centrifugal effect to pre-separate the vapor from liquid, and a cyclonic effect to promote separation of vapor from the liquid. To attain these effects, device 180 includes a pre-rotational section 188 and a controlled cyclonic vertical section 190 having an upper portion 190*a* and a lower portion 190*b*. The vapor portion having low liquid volume fraction is discharged through the vapor outlet port 184 having a diameter (DV). Upper portion 190*a* which is partially or totally open and has an internal diameter (DII) in certain embodiments in the range of $0.5 < DV/DII < 1.3$. The liquid portion with low vapor volume fraction is discharged from liquid port 186 having an internal diameter (DL) in certain embodiments in the range of $0.1 < DL/DII < 1.1$. The liquid portion is collected and discharged from the bottom of flash vessel 179.

In order to enhance and to control phase separation, heating steam can be used in the vapor-liquid separation device 80 or 180, particularly when used as a standalone apparatus or is integrated within the inlet of a flash vessel.

While the various members are described separately and with separate portions, it will be understood by one of ordinary skill in the art that apparatus 80 or apparatus 180 can be formed as a monolithic structure, e.g., it can be cast or molded, or it can be assembled from separate parts, e.g., by welding or otherwise attaching separate components together which may or may not correspond precisely to the members and portions described herein.

It will be appreciated that although various dimensions are set forth as diameters, these values can also be equivalent effective diameters in embodiments in which the components parts are not cylindrical.

Mixed product stream 39 is passed to the inlet of quenching zone 40 with a quenching solution 42 (e.g., water and/or pyrolysis fuel oil) introduced via a separate inlet to produce a quenched mixed product stream 44 having a reduced temperature, e.g., of about 300° C., and spent quenching solution 46 is discharged. The gas mixture effluent 39 from the cracker is typically a mixture of hydrogen, methane, hydrocarbons, carbon dioxide and hydrogen sulfide. After cooling with water or oil quench, mixture 44 is compressed in a multi-stage compressor zone 51, typically in 4-6 stages to produce a compressed gas mixture 52. The compressed gas mixture 52 is treated in a caustic treatment unit 53 to produce a gas mixture 54 depleted of hydrogen sulfide and carbon dioxide. The gas mixture 54 is further compressed in a compressor zone 55, and the resulting cracked gas 56 typically undergoes a cryogenic treatment in unit 57 to be dehydrated, and is further dried by use of molecular sieves.

The cold cracked gas stream 58 from unit 57 is passed to a de-methanizer tower 59, from which an overhead stream 60 is produced containing hydrogen and methane from the cracked gas stream. The bottoms stream 65 from de-methanizer tower 59 is then sent for further processing in product separation zone 70, comprising fractionation towers including de-ethanizer, de-propanizer and de-butanizer towers. Process configurations with a different sequence of de-methanizer, de-ethanizer, de-propanizer and de-butanizer can also be employed.

According to the processes herein, after separation from methane at the de-methanizer tower 59 and hydrogen recovery in unit 61, hydrogen 62 having a purity of typically 80-95 vol % is obtained, which can be further purified as needed or combined with other off gases in the refinery. In addition, a portion of hydrogen from stream 62 can be utilized for the hydrogenation reactions of acetylene, methylacetylene and propadienes (not shown). In addition, according to the processes herein, methane stream 63 can optionally be recycled to the steam cracker to be used as fuel for burners and/or heaters.

The bottoms stream 65 from de-methanizer tower 59 is conveyed to the inlet of product separation zone 70 to be separated into product streams methane, ethylene, propylene, butadiene, mixed butylenes and pyrolysis gasoline discharged via outlets 78, 77, 76, 75, 74 and 73, respectively. Pyrolysis gasoline generally includes C5-C9 hydrocarbons, and benzene, toluene and xylenes can be extracted from this cut. Optionally one or both of the bottom asphalt phase 25 and the unvaporized heavy liquid fraction 38 from the vapor-liquid separation section 36 are combined with pyrolysis fuel oil 71 (e.g., materials boiling at a temperature higher than the boiling point of the lowest boiling C10 compound, known as a "C10+" stream) and the mixed stream can be withdrawn as a pyrolysis fuel oil blend 16, e.g., to be further processed in an off-site refinery (not shown). In certain embodiments, the bottom asphalt phase 25 can be sent to an asphalt stripper (not shown) where any remaining solvent is stripped-off, e.g., by steam.

Solvent deasphalting is a unique separation process in which residue is separated by molecular weight (density), instead of by boiling point, as in the vacuum distillation process. The solvent deasphalting process thus produces a low-contaminant deasphalted oil (DAO) rich in paraffinic type molecules, consequently decreases the BMCI as compared to the initial feedstock.

Solvent deasphalting is usually carried out with paraffin streams having carbon number ranging from 3-7, in certain embodiments ranging from 4-5, and below the critical conditions of the solvent. Table 1 lists the properties of commonly used solvents in solvent deasphalting.

TABLE 1

Properties Of Commonly Used Solvents In Solvent Deasphalting

| Name | Formula | MW g/g-mol | Boiling Point ° C. | Specific Gravity | Critical Temperature ° C. | Critical Pressure bar |
|---|---|---|---|---|---|---|
| propane | C3 H8 | 44.1 | −42.1 | 0.508 | 96.8 | 42.5 |
| n-butane | C4 H10 | 58.1 | −0.5 | 0.585 | 152.1 | 37.9 |
| i--butane | C4 H10 | 58.1 | −11.7 | 0.563 | 135.0 | 36.5 |
| n-pentane | C5 H12 | 72.2 | 36.1 | 0.631 | 196.7 | 33.8 |
| i--pentane | C5 H12 | 72.2 | 27.9 | 0.625 | 187.3 | 33.8 |

The feed is mixed with a light paraffinic solvent with carbon numbers ranging 3-7, where the deasphalted oil is solubilized in the solvent. The insoluble pitch will precipitate out of the mixed solution and is separated from the DAO phase (solvent-DAO mixture) in the extractor.

Solvent deasphalting is carried-out in liquid phase and therefore the temperature and pressure are set accordingly. There are two stages for phase separation in solvent deasphalting. In the first separation stage, the temperature is maintained lower than that of the second stage to separate the bulk of the asphaltenes. The second stage temperature is maintained to control the deasphalted/demetalized oil (DA/DMO) quality and quantity. The temperature has big impact on the quality and quantity of DA/DMO. An extraction temperature increase will result in a decrease in deasphalted/demetalized oil yield, which means that the DA/DMO will be lighter, less viscous, and contain less metals, asphaltenes, sulfur, and nitrogen. A temperature decrease will have the opposite effects. In general, the DA/DMO yield decreases having higher quality by raising extraction system temperature and increases having lower quality by lowering extraction system temperature.

The composition of the solvent is an important process variable. The solubility of the solvent increases with increasing critical temperature, generally according to C3<iC4<nC4<iC5. An increase in critical temperature of the solvent increases the DA/DMO yield. However, it should be noted that the solvent having the lower critical temperature has less selectivity resulting in lower DA/DMO quality.

The volumetric ratio of the solvent to the solvent deasphalting unit charge impacts selectivity and to a lesser degree on the DA/DMO yield. Higher solvent-to-oil ratios result in a higher quality of the DA/DMO for a fixed DA/DMO yield. Higher solvent-to-oil ratio is desirable due to better selectivity, but can result in increased operating costs thereby the solvent-to-oil ratio is often limited to a narrow range. The composition of the solvent will also help to establish the required solvent to oil ratios. The required solvent to oil ratio decreases as the critical solvent temperature increases. The solvent to oil ratio is, therefore, a function of desired selectivity, operation costs and solvent composition.

The method and system herein provides improvements over known steam pyrolysis cracking processes:

use of crude oil as a feedstock to produce petrochemicals such as olefins and aromatics;

the hydrogen content of the feed to the steam pyrolysis zone is enriched for high yield of olefins;

in certain embodiments coke precursors are significantly removed from the initial whole crude oil which allows a decreased coke formation in the radiant coil; and in certain embodiments additional impurities such as metals, sulfur and nitrogen compounds are also significantly removed from the starting feed which avoids post treatments of the final products.

The method and system of the present invention have been described above and in the attached drawings; however, modifications will be apparent to those of ordinary skill in the art and the scope of protection for the invention is to be defined by the claims that follow.

The invention claimed is:

1. An integrated solvent deasphalting and steam pyrolysis system for the direct processing of a crude oil to produce olefinic and aromatic petrochemicals, the system comprising:

a solvent deasphalting zone having a deasphalted and demetalized oil stream outlet and a bottom asphalt outlet;

a thermal cracking zone including a thermal cracking convection section with an inlet in fluid communication with the deasphalted and demetalized oil stream outlet of the solvent deasphalting zone, and an outlet, a vapor-liquid separator having an inlet in fluid communication with the thermal cracking convection section outlet, a vapor fraction outlet and a liquid fraction outlet, wherein the vapor-liquid separator includes:

a pre-rotational element having an entry portion and a transition portion, the entry portion having an inlet for receiving a flowing fluid mixture from the thermal cracking convection section outlet, and a curvilinear conduit;

a controlled cyclonic section having an inlet adjoined to the pre-rotational element through convergence of the curvilinear conduit and the cyclonic section, a riser section at an upper end of the cyclonic member in fluid communication with the vapor fraction outlet of the vapor-liquid separator through which vapors pass to a thermal cracking pyrolysis section; and a liquid collector/settling section through which liquid passes, and the thermal cracking pyrolysis section having an inlet in fluid communication with the vapor fraction outlet of the vapor-liquid separator, and a pyrolysis section outlet;

a quenching zone in fluid communication with the pyrolysis section outlet, the quenching zone having an outlet for discharging an intermediate quenched mixed product stream and an outlet for discharging quenching solution; and a product separation zone in fluid communication with the intermediate quenched mixed product stream outlet, and having a hydrogen outlet, one or more olefin product outlets and one or more pyrolysis fuel oil outlets.

2. The integrated system of claim 1, further comprising:

a first compressor zone having an inlet in fluid communication with the quenching zone outlet discharging an intermediate quenched mixed product stream and an outlet discharging a compressed gas mixture;

a caustic treatment unit having an inlet in fluid communication with the first compressor zone outlet discharging a compressed gas mixture, and an outlet discharging a gas mixture depleted of hydrogen sulfide and carbon dioxide; and a second compressor zone having an inlet in fluid communication with the caustic treatment unit outlet, and an outlet for discharging compressed cracked gas;

a dehydration zone having an inlet in fluid communication with the second compressor zone outlet, and an outlet for discharging a cold cracked gas stream;

the product separation zone including a de-methanizer tower, a de-ethanizer tower, a de-propanizer tower and a de-butanizer tower;

the de-methanizer tower having an inlet in fluid communication with the dehydration zone outlet, an outlet for discharging an overhead stream containing hydrogen and methane and an outlet for discharging a bottoms stream, wherein the hydrogen purification zone is in fluid communication with the de-methanizer tower overhead outlet; and the de-ethanizer tower having an inlet in fluid communication with with the bottoms stream outlet of the de-methanizer tower.

3. The integrated system of claim 2, further comprising burners and/or heaters associated with the thermal cracking zone in fluid communication with the de-methanizer unit.

4. The integrated system of claim 1, further comprising a deasphalted and demetalized oil separator having an inlet in fluid communication with the deasphalted and demetalized oil stream outlet of the solvent deasphalting zone, a light fraction outlet and a heavy fraction outlet, the light fraction outlet in fluid communication with the convection section.

5. The integrated system of claim 4, wherein the deasphalted and demetalized oil separator is a flash separator.

6. The integrated system of claim 4, wherein the deasphalted and demetalized oil separator is a deasphalted and demetalized oil vapor-liquid separator that is a physical or mechanical apparatus for separation of vapors and liquids.

7. The integrated system of claim 6, wherein the deasphalted and demetalized oil vapor-liquid separator includes:

a pre-rotational element having an entry portion and a transition portion, the entry portion having an inlet for receiving a flowing fluid mixture from the deasphalted and demetalized oil stream outlet, and a curvilinear conduit;

a controlled cyclonic section having an inlet adjoined to the pre-rotational element through convergence of the curvilinear conduit and the cyclonic section, a riser section at an upper end of the cyclonic member in fluid communication with the light fraction outlet of the deasphalted and demetalized oil vapor-liquid separator through which vapors pass to the convection section; and a liquid collector/settling section in fluid communication with the heavy fraction outlet of the deasphalted and demetalized oil vapor-liquid separator though which liquid passes.

8. The integrated system of claim 1, wherein the solvent deasphalting zone includes:

a solvent deasphalting mixing zone that includes an inlet for the crude oil feedstock, an inlet for fresh solvent, an inlet for make-up solvent, and an outlet;

a primary settler in fluid communication with the solvent deasphalting mixing zone outlet having an inlet for receiving a mixture from the solvent deasphalting mixing zone and a secondary asphalt phase, an outlet for discharging a primary deasphalted and demetalized oil phase and an outlet for a primary asphalt phase;

a secondary settler in fluid communication with the primary settler primary deasphalted and demetalized oil phase outlet having an inlet for receiving the primary deasphalted and demetalized oil phase, an outlet for discharging a secondary deasphalted and demetalized oil phase and an outlet for the secondary asphalt phase;

a deasphalted and demetalized separation zone in fluid communication with the secondary deasphalted and demetalized oil phase outlet for receiving the secondary deasphalted and demetalized oil phase, an outlet for a recycle solvent stream and an outlet for a substantially solvent-free deasphalted and demetalized oil stream, wherein the outlet for a substantially solvent-free deasphalted and demetalized oil stream is in fluid communication with the inlet of the thermal cracking zone;

a separator vessel in fluid communication with the primary asphalt phase outlet for receiving the primary asphalt phase, an outlet for recycle solvent and an outlet for a bottom asphalt phase.

9. The integrated system of claim 1, wherein the deasphalted and demetalized oil stream is in direct fluid communication with the steam pyrolysis zone.

10. An integrated solvent deasphalting and steam pyrolysis system for the direct processing of a crude oil to produce olefinic and aromatic petrochemicals, the system comprising:

a solvent deasphalting zone having a deasphalted and demetalized oil stream outlet and a bottom asphalt outlet;

a deasphalted and demetalized oil separator having an inlet in fluid communication with the deasphalted and demetalized oil stream outlet of the solvent deasphalting zone, a light fraction outlet and a heavy fraction outlet, wherein deasphalted and demetalized oil separator is a deasphalted and demetalized oil vapor-liquid separator that includes:

a pre-rotational element having an entry portion and a transition portion, the entry portion having an inlet for receiving a flowing fluid mixture from the deasphalted and demetalized oil stream outlet, and a curvilinear conduit;

a controlled cyclonic section having an inlet adjoined to the pre-rotational element through convergence of the curvilinear conduit and the cyclonic section, a riser section at an upper end of the cyclonic member in fluid communication with the light fraction outlet of the deasphalted and demetalized oil vapor-liquid separator through which vapors pass to a thermal cracking section of a thermal cracking zone; and a liquid collector/settling section in fluid communication with the heavy fraction outlet of the deasphalted and demetalized oil vapor-liquid separator through which liquid passes the thermal cracking zone including the thermal cracking convection section with an inlet in fluid communication with the light fraction outlet of the deasphalted and demetalized oil vapor-liquid separator, and an outlet, and a thermal cracking pyrolysis section having an inlet in fluid communication with the outlet of the convection section, and a pyrolysis section outlet;

a quenching zone in fluid communication with the pyrolysis section outlet, the quenching zone having an outlet for discharging an intermediate quenched mixed product stream and an outlet for discharging quenching solution; and a product separation zone in fluid communication with the intermediate quenched mixed product stream outlet, and having a hydrogen outlet, one or more olefin product outlets and one or more pyrolysis fuel oil outlets.

11. The integrated system of claim 10, further comprising:

a first compressor zone having an inlet in fluid communication with the quenching zone outlet discharging an intermediate quenched mixed product stream and an outlet discharging a compressed gas mixture;

a caustic treatment unit having an inlet in fluid communication with the first compressor zone outlet discharging a compressed gas mixture, and an outlet discharging a gas mixture depleted of hydrogen sulfide and carbon dioxide; and a second compressor zone having an inlet in fluid communication with the caustic treatment unit outlet, and an outlet for discharging compressed cracked gas;

a dehydration zone having an inlet in fluid communication with the second compressor zone outlet, and an outlet for discharging a cold cracked gas stream;

the product separation zone including a de-methanizer tower, a de-ethanizer tower, a de-propanizer tower and a de-butanizer tower;

the de-methanizer tower having an inlet in fluid communication with the dehydration zone outlet, an outlet for discharging an overhead stream containing hydrogen and methane and an outlet for discharging a bottoms stream, wherein the hydrogen purification zone is in fluid communication with the de-methanizer tower overhead outlet; and the de-ethanizer tower having an inlet in fluid communication with with the bottoms stream outlet of the de-methanizer tower.

12. The integrated system of claim 11, further comprising burners and/or heaters associated with the thermal cracking zone in fluid communication with the de-methanizer unit.

13. The integrated system of claim 10, further comprising a thermal cracking vapor-liquid separator having an inlet in fluid communication with the thermal cracking convection section outlet, a vapor fraction outlet and a liquid fraction outlet, the vapor fraction outlet in fluid communication with the pyrolysis section.

14. The integrated system of claim 13, wherein the thermal cracking vapor-liquid separator is a physical or mechanical apparatus for separation of vapors and liquids.

15. The integrated system of claim 13, wherein the thermal cracking vapor-liquid separator includes:

a pre-rotational element having an entry portion and a transition portion, the entry portion having an inlet for receiving a flowing fluid mixture from the thermal cracking convection section outlet, and a curvilinear conduit;

a controlled cyclonic section having an inlet adjoined to the pre-rotational element through convergence of the curvilinear conduit and the cyclonic section, a riser section at an upper end of the cyclonic member in fluid communication with the vapor fraction outlet of the thermal cracking vapor-liquid separator through which vapors pass to the pyrolysis section; and a liquid collector/settling section in fluid communication with the liquid outlet of the thermal cracking vapor-liquid separator through which liquid passes.

16. The integrated system of claim 10, wherein the solvent deasphalting zone includes:

a solvent deasphalting mixing zone that includes an inlet for the crude oil feedstock, an inlet for fresh solvent, an inlet for make-up solvent, and an outlet;

a primary settler in fluid communication with the solvent deasphalting mixing zone outlet having an inlet for receiving a mixture from the solvent deasphalting mixing zone and a secondary asphalt phase, an outlet for discharging a primary deasphalted and demetalized oil phase and an outlet for a primary asphalt phase;

a secondary settler in fluid communication with the primary settler primary deasphalted and demetalized oil phase outlet having an inlet for receiving the primary deasphalted and demetalized oil phase, an outlet for discharging a secondary deasphalted and demetalized oil phase and an outlet for the secondary asphalt phase;

a deasphalted and demetalized separation zone in fluid communication with the secondary deasphalted and demetalized oil phase outlet for receiving the secondary deasphalted and demetalized oil phase, an outlet for a recycle solvent stream and an outlet for a substantially solvent-free deasphalted and demetalized oil stream, wherein the outlet for a substantially solvent-free deasphalted and demetalized oil stream is in fluid communication, with the inlet of the thermal cracking zone;

a separator vessel in fluid communication with the primary asphalt phase outlet for receiving the primary asphalt phase, an outlet for recycle solvent and an outlet for a bottom asphalt phase.

17. The integrated system of claim 10, wherein the deasphalted and demetalized oil stream is in direct fluid communication with the steam pyrolysis zone.

* * * * *